US010815746B2

(12) United States Patent
Holst et al.

(10) Patent No.: US 10,815,746 B2
(45) Date of Patent: Oct. 27, 2020

(54) MULTI-COUPLER CONNECTOR

(71) Applicant: Parker-Hannifin Corporation, Cleveland, OH (US)

(72) Inventors: Andrew J. Holst, Plymouth, MN (US); Leonard Nick, Rockford, MN (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 16/345,087

(22) PCT Filed: Oct. 25, 2017

(86) PCT No.: PCT/US2017/058247

§ 371 (c)(1),
(2) Date: Apr. 25, 2019

(87) PCT Pub. No.: WO2018/081241

PCT Pub. Date: May 3, 2018

(65) Prior Publication Data

US 2019/0249508 A1 Aug. 15, 2019

Related U.S. Application Data

(60) Provisional application No. 62/453,136, filed on Feb. 1, 2017, provisional application No. 62/413,739, filed on Oct. 27, 2016.

(51) Int. Cl.
*E21B 33/038* (2006.01)

(52) U.S. Cl.
CPC ..... *E21B 33/038* (2013.01)

(58) Field of Classification Search
CPC ..... E21B 33/038; E21B 41/04
See application file for complete search history.

(56) References Cited

U.S. PATENT DOCUMENTS 2,585,113 A 2/1946 Gredell
4,084,630 A 4/1978 Lewis
(Continued)

FOREIGN PATENT DOCUMENTS

EP 2264278 A2 12/2010
GB 2408299 A 5/2005
GB 2511546 A 9/2014

OTHER PUBLICATIONS

PCT/US2017/058247; PCT International Search Report and Written Opinion of the International Searching Authority dated May 11, 2018.

(Continued)

*Primary Examiner* — James G Sayre
(74) *Attorney, Agent, or Firm* — Renner, Otto, Boisselle & Sklar, LLP

(57) ABSTRACT

A connector (12) such as a multi-coupler stabplate for coupling to or decoupling from another connector (14). The connector may have a secondary release mechanism (80) that allows a seized drive to be rotated to an unlocked position independent of the connector housing moving relative to a multi-coupler plate. Integrated stop features may be provided during such secondary release. The secondary release mechanism may be mounted to the housing (56) and retained with shear pins. Orientation pin(s) (62) may be provided that cooperate with a guide slot(s) (64) for oblique and axial movement of a locking mechanism (46) during coupling/decoupling. A housing shroud (76) may be provided for cooperating with the orientation pin(s) and indicating locked/unlocked states. A stop collar (70) and push-off flange (74) may be provided for facilitating coupling/decoupling. Guide bushings (44) may be provided for facilitating alignment during coupling. One or more addi- (Continued)

tional features may be provided that improve the securing/releasing function(s) of the connector.

21 Claims, 8 Drawing Sheets

(56) References Cited

U.S. PATENT DOCUMENTS 5,024,467 A * 6/1991 Truchet ..... F16L 37/002 285/365
5,794,701 A 8/1998 Cunningham et al.
6,009,950 A * 1/2000 Cunningham ..... E21B 34/06 166/344
8,011,434 B2 9/2011 Cosgrove et al.
8,499,839 B2 8/2013 Reid et al.
2004/0127084 A1* 7/2004 Glennie ..... E21B 33/0385 439/316
2008/0202760 A1* 8/2008 Cosgrove ..... E21B 33/038 166/341
2010/0186964 A1* 7/2010 Reid ..... E21B 33/038 166/341
2010/0200240 A1* 8/2010 Biester ..... E21B 33/038 166/338
2010/0209198 A1* 8/2010 Piper ..... E21B 33/038 405/170
2011/0088909 A1* 4/2011 Hamblin ..... E21B 41/04 166/340
2012/0175123 A1* 7/2012 Roberts ..... E21B 33/0355 166/340
2013/0309016 A1 11/2013 McKee et al.

OTHER PUBLICATIONS

PCT/US2017/058247; Second Written Opinion of the International Searching Authority dated Oct. 8, 2018.
Parker-Hannifin; "Subsea Connection Systems Stab Plates and Quick Couplings MCD Series Plates / DSL Series Coupling QCD-MCD/DSL" dated Apr. 2016.
PCT/US2017/058247; PCT International Preliminary Report on Patentability of the International Preliminary Examining Authority dated Jan. 8, 2019.

* cited by examiner

FIG. 8
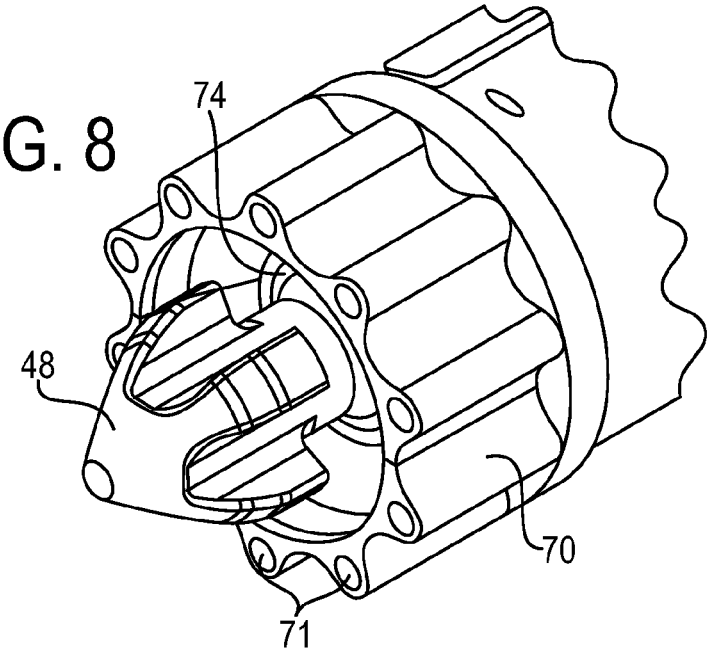
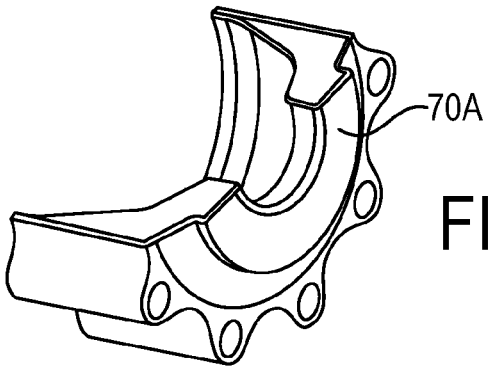
FIG. 9
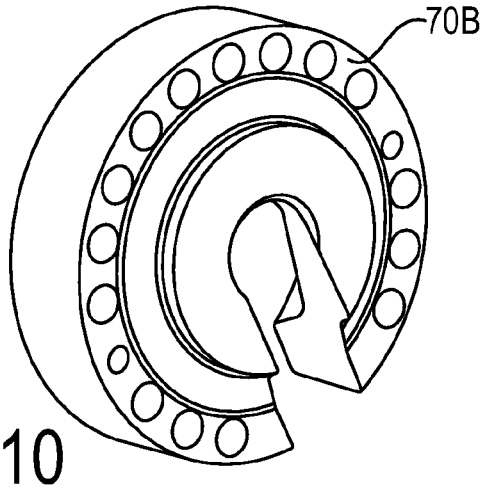
FIG. 10

MULTI-COUPLER CONNECTOR

RELATED APPLICATIONS

This application is a national phase of International Application No. PCT/US2017/058247 filed Oct. 25, 2017 and published in the English language, which claims the benefit of both U.S. Provisional Application No. 62/453,136 filed Feb. 1, 2017 and U.S. Provisional Application No. 62/413,739 filed Oct. 27, 2016, all of which are hereby incorporated herein by reference in their entireties.

FIELD OF INVENTION

The present invention relates generally to a connector, and more particularly to a multi-coupler connector, such as a stabplate, particularly for use in sub-sea applications.

BACKGROUND

Multi-coupler connectors known as stabplates may be coupled together to connect high-pressure fluid lines, electrical power lines, or other communication lines, often under severe sub-sea conditions. One half of the sub-sea coupling typically is a fixed stabplate that is attached to base equipment on the control side of the sub-sea system. The other half of the sub-sea coupling is a free stabplate that initially is moveable into position for coupling relative to the fixed stabplate. Each stabplate typically has multiple couplers that are connected to conduits, such as hoses or tubing, which allows the conduits from each stabplate to be simultaneously connected via the couplers in a single operation, rather than requiring the individual connection of each coupler.

In order to ensure proper connection of each coupler, the free stabplate typically is provided with one or more location features which are aligned with corresponding features provided on the fixed stabplate before the stabplates are secured to one another. Once properly aligned, the stabplates are securely attached to one another to resist separation forces experienced during use, such as hydraulic forces, to prevent separation of the stabplates from one another. A locking mechanism, such as a bayonet, may be employed to connect the stabplates in this manner. The locking mechanism typically includes a drive mechanism for forcing the free stabplate to join with the fixed stabplate in a locked configuration.

In sub-sea operations, the combination of salt water, high pressures, and other adverse local conditions results in a highly corrosive environment. As such, the drive mechanism may sometimes seize as a result of material galling under high load, corrosion from extended use sub-sea, or a buildup of marine growth, which would thereby prevent the stabplates from being released and disconnected from each other. In order to permit release of the stabplates in the event of a failure in the drive mechanism or locking mechanism, a secondary release mechanism may be provided.

SUMMARY OF INVENTION

The present invention provides a connector having one or more features that improve the securing and releasing function(s) of the connector to or from another connector under severe service conditions, such as may be found in sub-sea applications.

For example, the connector may be a multi-coupler connector, such as a free stabplate, having one or more features according to the following aspects of the invention.

According to one aspect, a free connector is provided for connecting to a fixed connector of a coupling, the free connector including: a free plate having a front side and a back side; a locking mechanism extending along an axis through the free plate for being received by the fixed connector, the locking mechanism being rotatable about the axis between a locked position for securing the free connector to the fixed connector, and an unlocked position for releasing the free connector from the fixed connector; a housing disposed on the back side of the free plate, the housing being fixed relative to the free plate and surrounding at least a portion of the locking mechanism; a guide sleeve interposed between the locking mechanism and the housing, the guide sleeve configured to guide movement of the locking mechanism between the locked position and the unlocked position; and a secondary release mechanism mounted to the housing, the secondary release mechanism having a hold state for restricting rotation of the guide sleeve relative to the housing, and a release state for permitting rotation of the guide sleeve relative to the housing.

Embodiments may include one or more of the following features alone or in combination.

For example, when the secondary release mechanism is in the hold state and restricts rotation of the guide sleeve relative to the housing, the locking mechanism may be guided by a guide slot in the guide sleeve to move between the locked position and unlocked position independent of movement of the guide sleeve.

When the secondary release mechanism is in the release state and permits rotation of the guide sleeve relative to the housing, the locking mechanism may be rotatable with the guide sleeve to move to the unlock position independent of the locking mechanism being guided by the guide slot of the guide sleeve.

The free connector may be configured to operate with the secondary release mechanism in the hold state during normal operation, and the release state may be activatable for when a drive mechanism that moves the locking mechanism is seized.

When the secondary release mechanism is in the release state, the locking mechanism may be movable to the unlocked position independent of the shearing of frangible elements.

The housing may have a slot for cooperating with the locking mechanism, the slot being configured to restrict rotation of the locking mechanism beyond a predetermined displacement when the secondary release mechanism is in the release state.

The slot in the housing may be configured as a through-slot or aperture.

The locking mechanism may include an orientation pin configured to extend through the through-slot for engaging the housing defining the through-slot when the locking mechanism is rotated to the unlocked position.

The orientation pin of the locking mechanism may be slidably movable in the guide slot of the guide sleeve to guide axial and/or circumferential movement of the locking mechanism.

The guide slot may include an oblique portion extending in an oblique direction that is both axially away from the free plate and circumferentially toward the lock position.

The guide slot may further include an axial portion extending in an axial direction away from the free plate.

The locking mechanism may include a drive nut at an end portion of the locking mechanism, the drive nut being engageable to rotate the locking mechanism between the locked position and unlocked position.

A torque receptacle may be coupled to the housing.

The locking mechanism may be configured as a bayonet having a head portion configured with a cruciform-shaped cross-section for being received in a corresponding socket of the fixed connector.

According to another aspect, a free connector is provided for connecting to a fixed connector of a coupling, the free connector comprising: a free plate having a front side and a back side; a locking mechanism extending along an axis through the free plate for being received by the fixed connector, the locking mechanism being rotatable about the axis between a locked position for securing the free connector to the fixed connector, and an unlocked position for releasing the free connector from the fixed connector; a drive mechanism operatively coupled to the locking mechanism for rotating the locking mechanism between the locked and unlocked positions; and a secondary release mechanism being activatable for enabling the locking mechanism to move to the unlocked position when the driving mechanism is seized; wherein secondary release mechanism includes a frangible element that is configured to fracture when loaded beyond a predetermined level for permitting the secondary release mechanism to be activated.

Embodiments may include one or more of the following features alone or in combination.

The drive mechanism may be a drive nut disposed at an axial end of the locking mechanism.

The secondary release mechanism may be mounted to a mounting portion of a housing, and the frangible element may include a retaining pin disposed in the mounting portion of the housing.

The retaining pin may be configured to engage the mounting portion of the housing when the secondary release mechanism is activated toward a release position, and the retaining pin may be configured to fracture when loaded beyond the predetermined level for permitting the secondary release mechanism to continue to move toward the release position.

According to another aspect, a free connector is provided for connecting to a fixed connector of a coupling, the free connector comprising: a free plate having a front side and a back side; a locking mechanism extending along an axis through the free plate for being received by the fixed connector, the locking mechanism being rotatable about the axis between a locked position for securing the free connector to the fixed connector, and an unlocked position for releasing the free connector from the fixed connector; and at least one of: (i) a stop collar that surrounds a portion of the locking mechanism for restricting forward movement of the locking mechanism toward the fixed connector; and (ii) a flange coupled to the locking mechanism for facilitating push-off between the free connector and the fixed connector when the connectors are separated, and/or for facilitating mating between the free connector and the fixed connector when the connectors are mated together.

Embodiments may include one or more of the following features alone or in combination.

The stop collar may be disposed between the free plate and a housing fixed to the free plate.

The stop collar may include a slot for slipping over a portion of the locking mechanism.

The stop collar may be configured in a clamshell or dual-c shape configuration.

The flange may be disposed between a head portion of the locking mechanism and the stop collar surrounding at least a portion of the locking mechanism.

The flange may be independent of the stop collar.

The flange may be integral with the locking mechanism.

According to another aspect, a free connector is provided for connecting to a fixed connector of a coupling, the fixed connector having at least one guide pin, the free connector comprising: a free plate having a front side and a back side; wherein the free plate has at least one guide bushing having an internal bore configured to receive the at least one guide pin of the fixed connector; and wherein the internal bore of the at least one guide bushing has a first internal diameter, a second internal diameter, and a third internal diameter; wherein the first internal diameter is at a forward end portion of the guide bushing that receives the guide pin, the third internal diameter is longitudinally spaced apart from the first internal diameter, and the second internal diameter is intermediate the first internal diameter and the third internal diameter; and wherein the second internal diameter is greater than the first internal diameter and the third internal diameter for enabling greater initial misalignment when the guide pin is initially inserted into the guide bushing.

Embodiments may include one or more of the following features alone or in combination.

The internal diameter of the internal bore may gradually reduce from the second internal diameter to the third internal diameter along the length of the internal bore.

The second diameter may be rearwardly adjacent to the first diameter.

The first diameter and the third diameter may be the same, or the first diameter and the third diameter may be different.

A fixed connector may be provided in combination with the free connector, wherein the guide pin of the fixed connector has a uniform diameter along a majority of the length of the guide pin.

According to another aspect, a free connector is provided for connecting to a fixed connector of a coupling, the free connector comprising: a free plate having a front side and a back side; a locking mechanism extending along an axis through the free plate for being received by the fixed connector, the locking mechanism being rotatable about the axis between a locked position for securing the free connector to the fixed connector, and an unlocked position for releasing the free connector from the fixed connector; a housing fixed to the free plate, the housing at least partially surrounding the locking mechanism on a side of the free plate that is opposite a side facing the fixed connector; and a housing shroud at least partially surrounding the housing; wherein the housing shroud includes an axial slot configured to receive an orientation pin of the locking mechanism, such that as the locking mechanism is rotated between the locked position and unlocked position, the orientation pin slides axially within the axial slot to effect rotation of the housing shroud about the axis, independent of axial movement of the housing shroud, for indicating whether the locking mechanism is in the locked or unlocked position.

In some embodiments, the housing shroud may have an integral indicator bar.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

FIG. 8 is a perspective view of an exemplary stop collar of the free connector in FIG. 3

FIG. 9 is a perspective view of another exemplary stop collar according to another embodiment of the invention.

FIG. 10 is a perspective view of another exemplary stop collar according to another embodiment of the invention.

DETAILED DESCRIPTION

The principles of the present invention have particular application to multi-coupler connectors for sub-sea applications, and more particularly to free connectors (also referred to as free stabplates or flying leads) that may be used to form a fluid coupling with a corresponding fixed connector, and thus will be described below chiefly in this context. It is also understood, however, that the principles and aspects of the present invention may be applicable to other connectors in other applications where it is desirable to improve the securing or releasing operation(s) of the connector to or from another connector. For example, the exemplary free connector and the fixed connector may be coupled together so as to communicate fluids, chemicals, electricity, or other communication streams. Alternatively or additionally, one or more of the multiple couplers of the free connector may be formed as protective caps that are configured to cover or plug the corresponding couplers in the fixed connector such that no fluid, electrical, or other streams are communicated between those couplers. It is also understood that the exemplary connector also may be utilized to connect to another connector that is devoid of couplers, such as a fixed parking plate, or the like.

Figure 1:
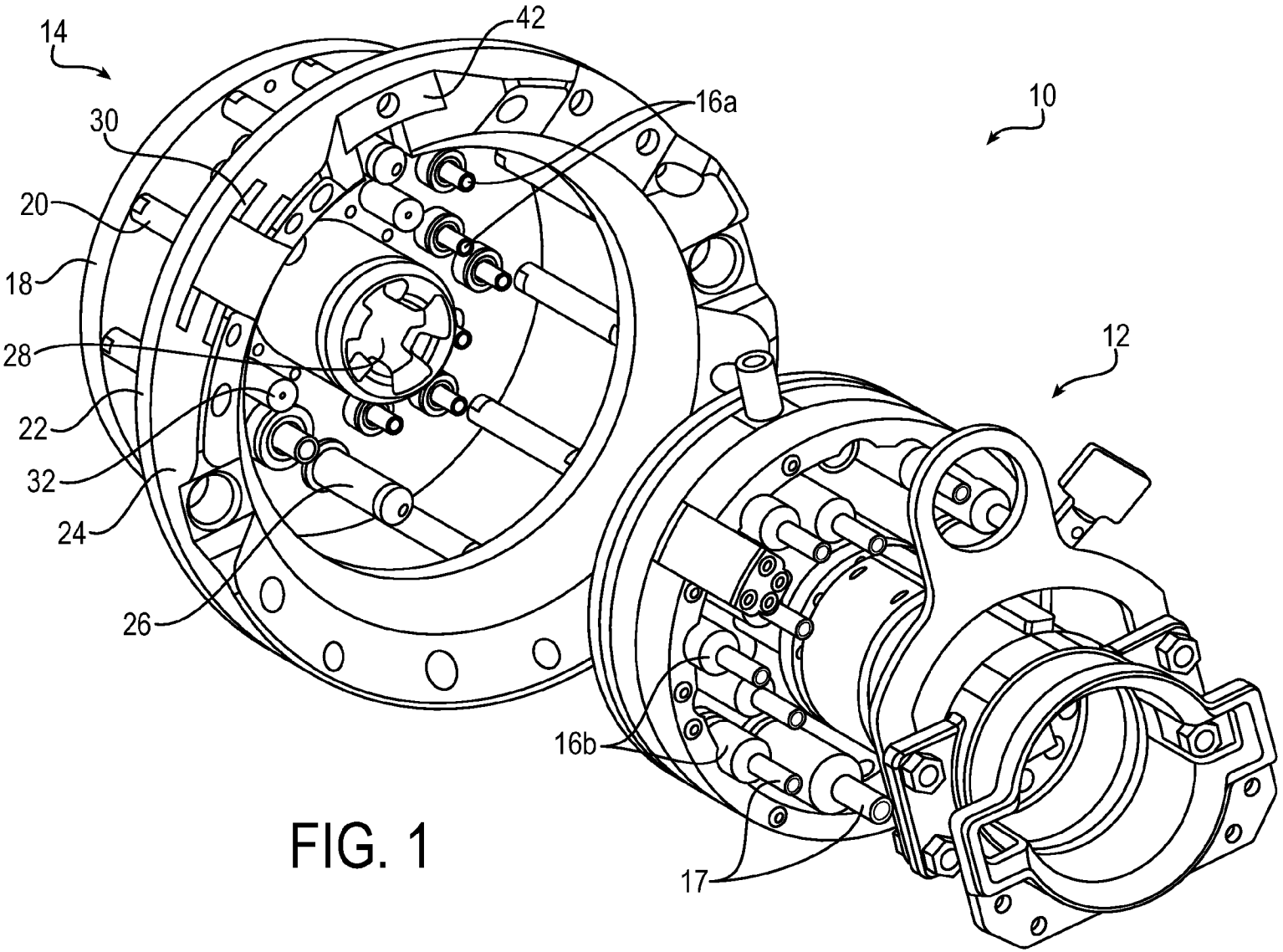
FIG. 1 is a perspective view of an exemplary coupling, including an exemplary fixed connector and an exemplary free connector, according to an embodiment of the invention.

Referring to FIG. 1, an exemplary sub-sea coupling 10 is shown. The coupling 10 includes an exemplary free connector 12 and a fixed connector 14. The fixed connector 14 may be attached to base equipment on a control side of a sub-sea system (not shown), and the free connector 12 initially is moveable into position, such as by remote operated vehicle, for coupling relative to the fixed connector 14. The fixed connector 14 has one or more couplers 16*a* (e.g., male quick couplers having communication passages) that are connected to conduits (hidden from view). The free connector 12 also has one or more couplers 16*b* (e.g., female quick couplers having communication passages) that correspond with the couplers 16*a*, and which also are connected to conduits 17. In this manner, the free connector 12 and fixed connector 14 may be coupled together to connect the one or more conduits 17 via the one or more couplers 16*a*, 16*b* on each side of the coupling 10 so as to communicate fluids, chemicals, electricity, or other communication streams between sub-sea equipment and related control systems, for example.

As shown, the fixed connector 14 is configured to receive the free connector 12 and may include a fixed plate 18, one or more support bars 20, a mounting ring 22, a guide funnel 24, one or more guide pins 26, a socket 28, a position indication marking 30, and one or more distance posts 32. The fixed plate 18 may have one or more openings extending between a front side and a rear side of the fixed plate 18 into which the respective couplers 16*a* are disposed. As shown, the guide funnel 24 may have a tapering form to assist in guiding the free connector 12 into alignment. The guide pins 26 may be received in corresponding bushings of the free connector 12, and the socket 28 may be configured to receive a locking mechanism of the free connector 12 for securably connecting or releasably disconnecting the connectors 12, 14, as will be described in further detail below. As mentioned above, it is understood that although the fixed connector 14 is shown and described as being a fluid connector having fluid couplers, other forms of communication may be provided by the fixed connector 14, such as gaseous, chemical, electrical, or other such communication. Alternatively or additionally, the fixed connector 14 may be configured as a parking plate that may be devoid of couplers, and which may be configured for receiving the free connector 12 in a temporary manner during field setup or maintenance.

Figure 2:
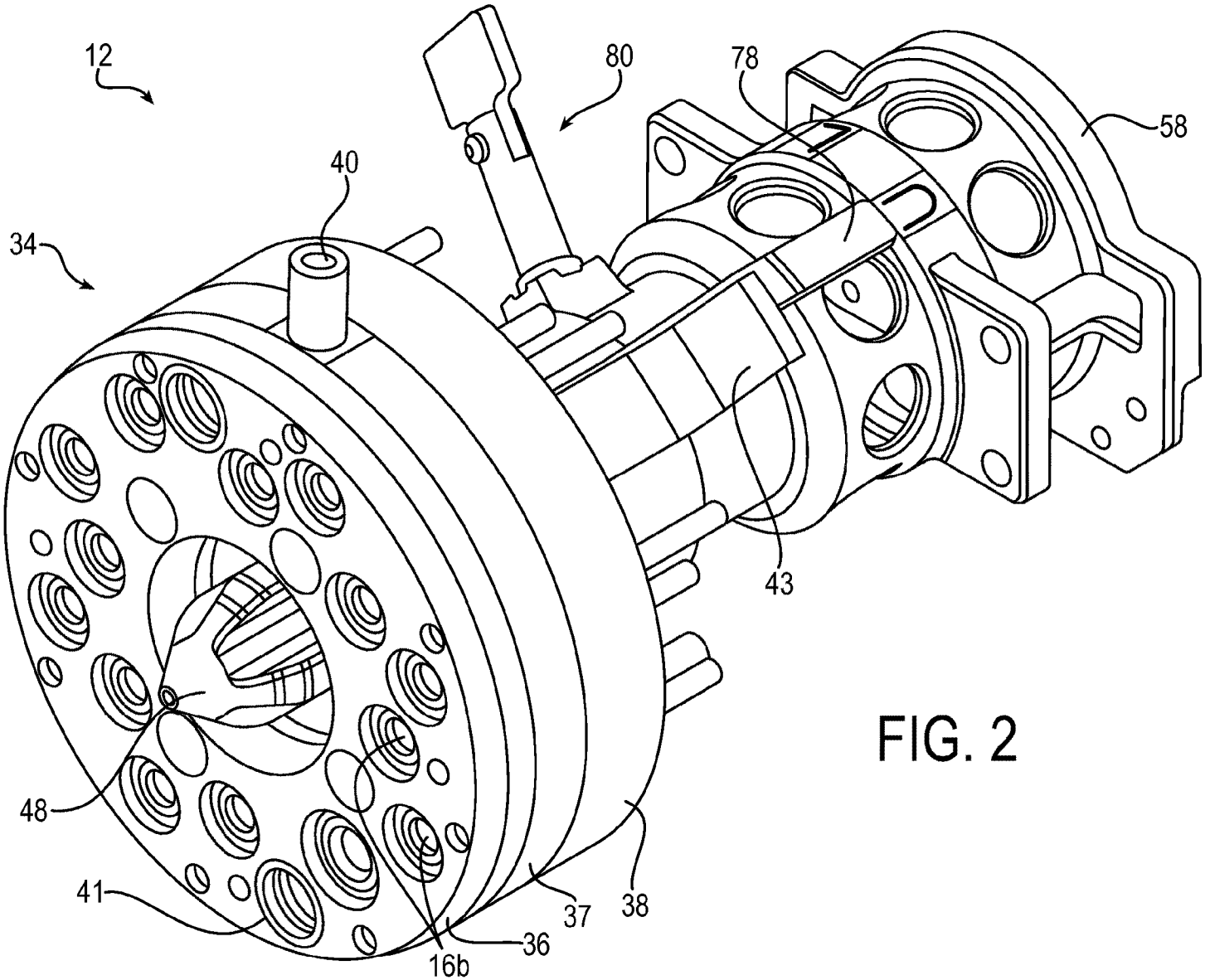
FIG. 2 is a perspective front view of the free connector in FIG. 1.
Figure 3:
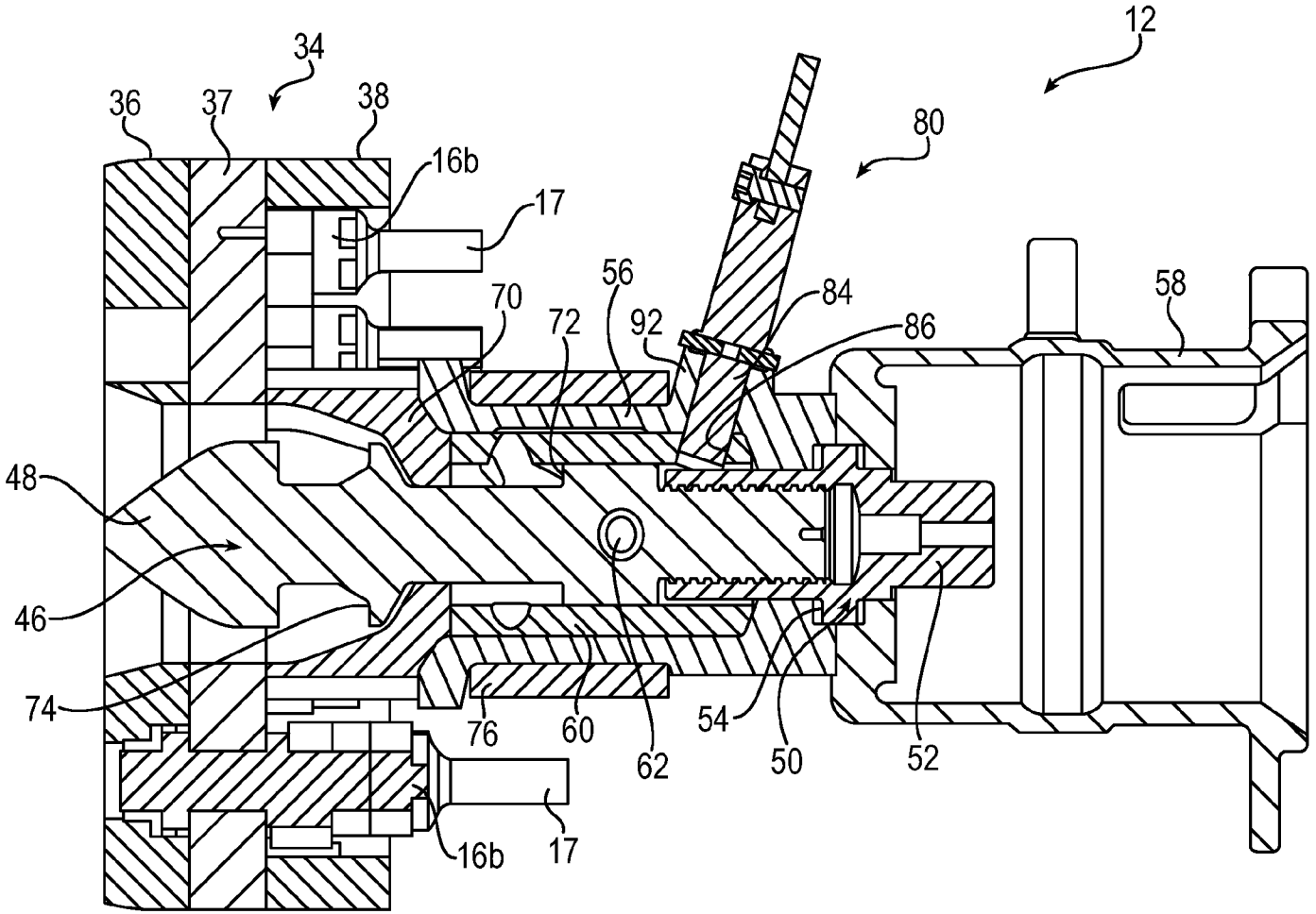
FIG. 3 is a cross-sectional view of the free connector in FIG. 2.

Referring to FIGS. 2 and 3, the exemplary free connector 12 is shown in further detail. The free connector 12 may include a plate assembly 34, which may include a protective plate 36, an intermediate plate 37 (also referred to as a free plate 37), and a guide hoop 38. As shown, the free plate 37 may have one more openings extending between a front side and a rear side, into which the respective couplers 16*b* are disposed. The free plate 37 may include an alignment post 40 for being received in a corresponding slot 42 (shown in FIG. 1) of the fixed connector 14, and which may enable primary rotational alignment between the connectors 12, 14. A position indicator 43 may cooperate with the position indication markings 30 of the fixed connector 14 to indicate alignment position. As mentioned above, it is understood that although the free connector 12 is shown and described as being a fluid connector having fluid couplers, other forms of communication may be provided by the free connector 12, such as gaseous, chemical, electrical, or other such communication. Alternatively or additionally, one or more of the couplers 16*b* of the free connector 12 may be formed as protective caps that are configured to cover or plug the corresponding couplers 16*a* in the fixed connector such that the free connector 12 may be utilized as a long-term or short-term cover in which no communication is established between those couplers 16*a*, 16*b*.

Figure 11:
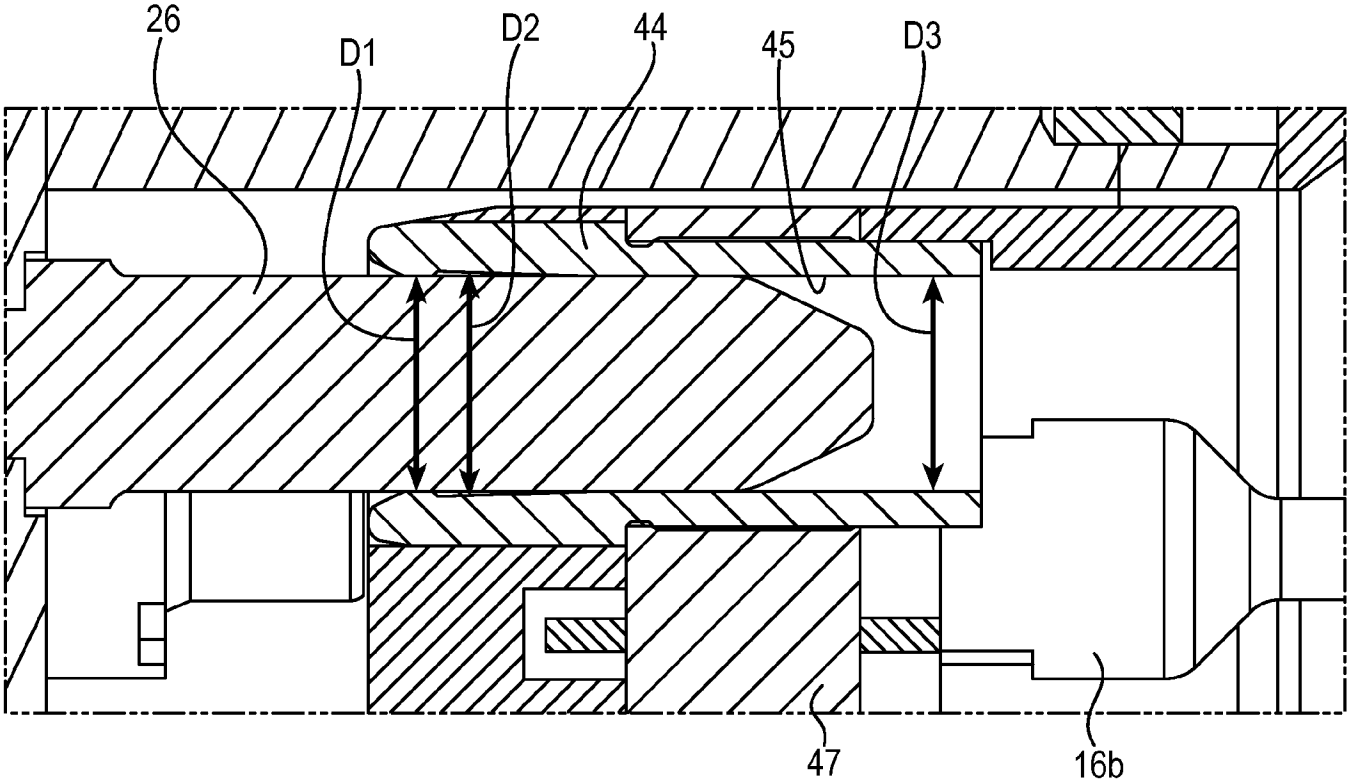
FIG. 11 is a cross-sectional view of an exemplary guide bushing of the free connector in FIG. 3.

As shown, the protective plate 36 may have one or more openings 41 for receiving the one or more guide pins 26 on the fixed plate 18. The free plate 37 may include one or more bushings 44 corresponding with the openings 41 for receiving the guide pins 26, and each of the bushings 44 have an internal bore 45 (shown in FIG. 11) for guiding the guide pins 26 as the connectors 12, 14 are coupled together. As will be described in further detail below, the internal bore 45 of each bushing 44 may have different diameters at longitudinally spaced positions along the internal bore for allowing greater initial misalignment when the guide pin 26 is initially inserted into the guide bushing 44 (as shown in FIG. 11, for example).

A locking mechanism 46 may extend along an axis through the free plate 37 for being received in the socket 28 of the fixed connector 14. The locking mechanism 46 is rotatable about the axis between a locked position for securing the free connector 12 to the fixed connector 14, and an unlocked position for releasing the free connector 12 from the fixed connector 14. In the illustrated embodiment, the locking mechanism 46 is configured as a bayonet having head portion 48 configured with a cruciform-shaped cross-section for being received in a correspondingly shaped socket 28 of the fixed connector 14. The locking mechanism 46 also includes (or is operatively coupled to) a drive mechanism 50 for rotating the locking mechanism 46 between the locked position and unlocked position. In the illustrated embodiment, the drive mechanism 50 includes a drive nut 52 and one or more thrust washers 54, where the drive nut 52 is engageable by the remote operated vehicle, for example, for moving between the locked and unlocked positions.

A housing 56 may be disposed on a rear side of the free plate 37 that is opposite a side facing the fixed connector. As shown, the housing 56 may surround at least a portion of the locking mechanism 46. A torque receptacle 58 also may be coupled to the housing 56. In the illustrated embodiment, the housing 56 is operatively fixed to the free plate 37 to restrict relative movement between the free plate 37 and the housing 56. As used herein, an "operative" connection, or a connection by which entities are "operatively connected," is one in which the entities are connected in such a way that the entities may perform as intended. For example, a connection in which entities are "operatively fixed" or "operatively connected" may be a direct connection, or an indirect connection in which an intermediate entity or entities cooperate or otherwise are part of the connection, or are in between the operably connected entities.

Figures 4A, 4B, 4C, 4D:
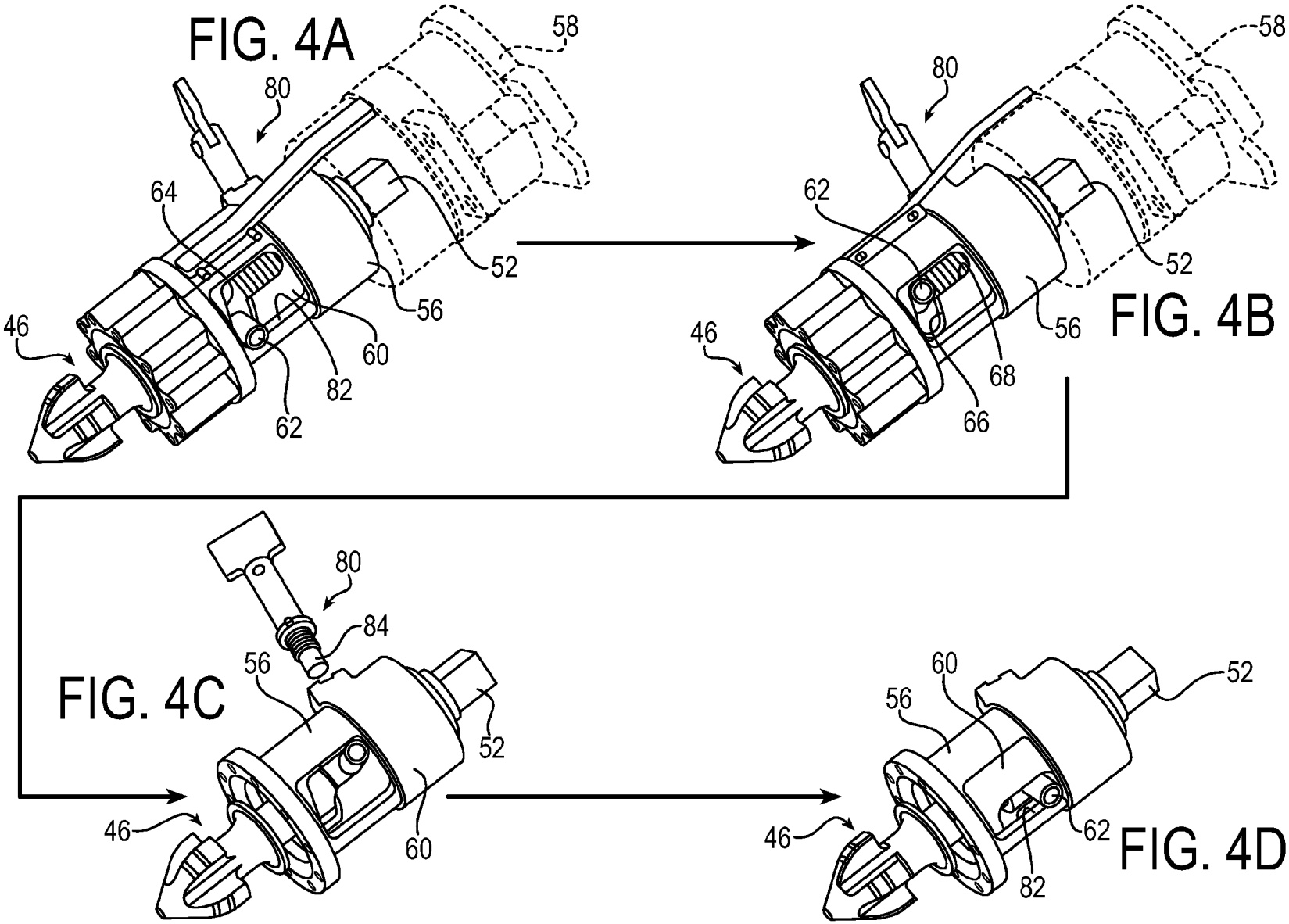
FIGS. 4A-4D illustrate an exemplary sequence of a connection operation and secondary release operation of the free connector in FIG. 2, with portions removed to improve clarity.

A guide sleeve 60 may be interposed between the locking mechanism 46 and the housing 56. The guide sleeve 60 may be configured to guide movement of the locking mechanism 46 between the locked position and the unlocked position. For example, the locking mechanism 46 may include an orientation pin 62 that is slidably movable in a guide slot 64 of the guide sleeve 60 (as shown in FIGS. 4A-4D, for example) to guide axial and/or circumferential movement of the locking mechanism 46. The guide slot 64 may include an oblique portion 66 extending in an oblique direction that is both axially away from the free plate 37 and circumferentially toward the lock position (e.g., clockwise as shown in FIGS. 4A-4D, for example). This allows the locking mechanism 46 (e.g., bayonet) to bring the fixed connector 14 and free connector 12 together as the locking mechanism is moving toward the locked position. The guide slot 64 may further include an axial portion 68 extending in an axial direction away from the free plate 37, to further bring the plates together (as shown in FIG. 4C, for example).

A stop collar 70 may surround a portion of the locking mechanism 46, and may be configured to engage a shoulder 72 of the locking mechanism for restricting forward movement of the locking mechanism 46 beyond a certain point, as will be discussed in further detail below. As shown, the stop collar 70 may be interposed between the free plate 37 and the housing 56, and may have one or more through-holes 71 (shown in FIG. 8, for example) for allowing the housing 56 to be fixed to the free plate 37 via one or more fasteners, or the like. As discussed in further detail below, the stop collar 70 may have an axial slot, or may be segmented, for facilitating installation of the stop collar 70 over a shaft portion of the locking mechanism 46.

As shown, the locking mechanism 46 may include a flange 74 for facilitating push-off between the free connector 12 and the fixed connector 14 when the connectors are separated, and/or for facilitating mating between the free connector 12 and the fixed connector 14 when the connectors are mated together, as discussed in further detail below. The flange 74 may be integral or unitary with the shaft portion of the locking mechanism 46, and the flange 74 may be independent of the stop collar 70. As shown, the flange 74 may be disposed between the head portion 48 of the locking mechanism and the stop collar 70.

Figure 12:
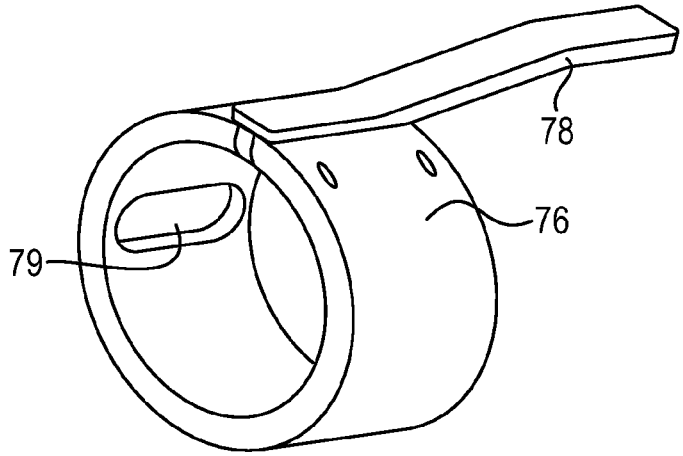
FIG. 12 is a perspective view of an exemplary housing shroud of the free connector in FIG. 2.

A housing shroud 76 may surround at least a portion of the housing 56. The housing shroud 76 may include an indicator 78, such as an indicator bar, for indicating whether the locking mechanism is in the locked or unlocked position. As will be discussed in further detail below, the housing shroud 76 may include an axial slot 79 (as shown in FIG. 12, for example) configured to receive the orientation pin 62 of the locking mechanism 46, such that as the locking mechanism 46 is rotated between the locked position and unlocked position, the orientation pin 62 slides axially within the axial slot 79 to effect rotation of the housing shroud 76 about the axis independent of axial movement of the housing shroud 76.

A secondary release mechanism 80 also may be provided, which may be mounted to the housing 56. As discussed in further detail below, the secondary release mechanism 80 may have a hold state that may be utilized during normal connect and disconnect operations of the free connector 12 in which the drive mechanism 50 is freely moveable, and may have a release state that may be utilized for when the drive mechanism is seized.

Referring particularly to FIGS. 4A-4D, and also to FIG. 3, the exemplary secondary release mechanism 80 will be described in further detail. During normal connect and disconnect operations of the free connector 12, the secondary release mechanism 80 is in the hold state and restricts rotation of the guide sleeve 60 relative to the housing 56, such that the orientation pin 62 of the locking mechanism 46 may be guided in the guide slot 64 of the guide sleeve 60 to move the locking mechanism between the locked position and unlocked position independent of movement of the guide sleeve 60. If the drive mechanism 50 becomes seized, however, and the secondary release mechanism 80 is activated to its release state, the guide sleeve 60 may rotate relative to the housing 56, such that both the guide sleeve 60 and the locking mechanism 46 (along with the operatively coupled drive mechanism 50) may rotate toward the unlock position independent of the orientation pin 62 of the locking mechanism 46 having to be guided in the guide slot 64. More particularly, in exemplary embodiments, such a configuration may enable the locking mechanism 46 to move to the unlocked position independent of the shearing of frangible elements, such as shear pins.

As shown in FIGS. 4A-4D, the housing 56 may have a slot 82 for cooperating with the orientation pin(s) 62 of the locking mechanism 46. For example, the housing slot 82 may be configured to restrict rotation of the locking mechanism 46 beyond a predetermined displacement when the secondary release mechanism 80 is in the release state. In the illustrated embodiment, the housing slot 82 is configured as a through-slot, and the orientation pin 62 is configured to extend through the through-slot 82 for engaging the housing defining the through-slot 82 when the locking mechanism 46 is rotated to the unlocked position. Such a configuration enables the orientation pin(s) 62 to be utilized as a stop feature by enabling the pin(s) to stop against the sides of the through-slot(s) 82 in the housing 56. In this manner, the design of the slot 82 may be configured for controlling the rotation of the locking mechanism 46 and the guide sleeve 60, which allows the locking mechanism 46 to rotate into an orientation that allows the free connector 12 to be releasably disconnected from the fixed connector 14. In addition, these same stop features provided by the housing slot(s) 82 also may be used to facilitate indication of the position of the locking mechanism 46, as described in further detail below.

In exemplary embodiments, the secondary release mechanism 80 includes a release pin 84 that is movable between a hold position corresponding with the hold state, and a release position corresponding with the release state. The release pin 84 may extend through the housing 56 and into a recess 86 of the guide sleeve 60 when the secondary release mechanism is in the hold position (as shown in FIG. 3, for example). The release pin 84 may move out of the recess 86 when in the release position, for example, the release pin 84 may be detachably removed from the housing 56.

FIGS. 4A-4D show an exemplary operation of the connection sequence and secondary release operation with only certain portions of the free connector 12 being shown to improve clarity. FIG. 4A represents the start condition where the locking mechanism 46 would be inserted into the socket 28 of the fixed connector 14 before rotation toward the locked position. FIG. 4B illustrates a state in which the drive nut 52 has been rotated clockwise to effect rotation of the locking mechanism 46 toward the locked position, and the orientation pin 62 being guided in the oblique portion 66 of the guide slot 64 (e.g., moving axially and circumferentially). This causes the locking mechanism 46 to lockingly engage the socket 28 of the fixed connector 14 and bring the connectors 12, 14 closer together. FIG. 4C illustrates a state in which the locking mechanism 46 has moved axially rearwardly with the orientation pin 62 being guided in the axial portion 68 of the guide slot 64, which causes the connectors 12, 14 to move closer together.

FIG. 4C also illustrates a state in which the drive mechanism 50 may be seized and the secondary release mechanism 80 is activated, such as by threading the release pin 84 out of the housing 56. As shown, when the release pin 84 is moved to a second position, such as being removed from the housing 56, the inner guide sleeve 60 is free to move relative to the fixed housing 56. Then, the inner guide sleeve 60 and the seized drive mechanism 50 can be rotated by use of torque applied to the drive nut 52. FIG. 4D illustrates a state in which the locking mechanism 46 has been rotated via the drive mechanism 50 to the unlocked position to release the connectors 12, 14 from each other after the secondary release mechanism 80 has been activated. As shown, the housing 56 stays fixed in position, and the inner components (e.g., guide sleeve 60, locking mechanism 46, and/or drive mechanism 50) rotate relative to the housing 56 to a releasable state. In addition, the orientation pin(s) 62 may be utilized as a stop feature by enabling the pin(s) to engage and stop against the sides of the through-slot 82, or aperture, defined by the housing 56.

Such configuration(s) of the secondary release mechanism 80 in cooperation with the guide sleeve 60, housing 56, and/or other connect/disconnect features of the free connector 12 may provide one or more advantages.

For example, in exemplary embodiments the secondary release mechanism 80 does not rely on the housing 56 moving relative to the free plate 37, which enables a removable pin type secondary release mechanism to be utilized. Such a configuration also may provide the ability to mount a frame to the torque receptacle 58 or the housing 56. In addition, such a configuration may enable the secondary release mechanism 80 to be mounted to the housing 56, instead of having an external frame connected the free plate 37 for attachment of the release pin 84.

In exemplary embodiments, the free connector 12 does not utilize shear pins for permitting rotation of the locking mechanism 46 when the secondary release mechanism is activated, and by eliminating such shear pins, there is no occurrence of inadvertently destroying the pins.

In exemplary embodiments, the locking mechanism 46 and/or drive mechanism 50 moves in an oblique direction (e.g., when the orientation pin 62 is guided in the oblique groove 66 during locking or unlocking) instead of rotating angularly first and then moving axially. Such an oblique path may therefore prevent unpredictable or inadvertent rotation of the locking mechanism 46.

In addition, in exemplary embodiments, the orientation pin(s) 62 may be utilized to control the oblique and axial movement of the locking mechanism 46, while also acting as a stop feature for the rotation of the locking mechanism toward the unlocked position when the secondary release mechanism 80 is activated.

In general, exemplary configuration(s) of the free connector provides a remote operated vehicle or diver operable secondary release mechanism that does not depend on shear pins, does not have a drive mechanism that depends on friction of the drive to rotate angularly and axially, and also does not have rotational movement between the housing and the free plate to activate a release feature.

Figure 5:
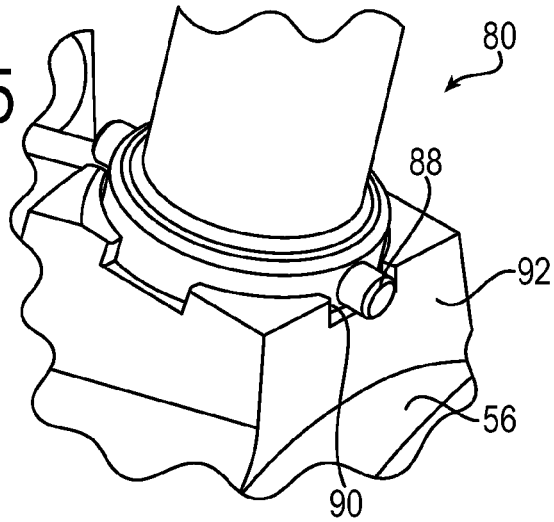
FIG. 5 is a close-up perspective view of an exemplary secondary release mechanism mounting portion of the free connector in FIG. 2.
Figure 6:
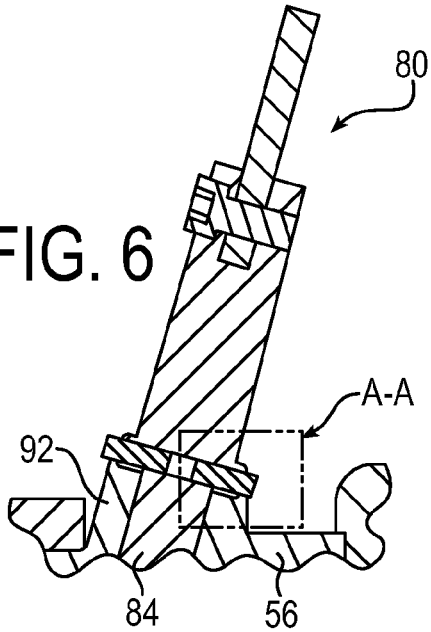
FIG. 6 is a cross-sectional side view of the secondary release mechanism mounting portion shown in FIG. 5.
Figure 7:
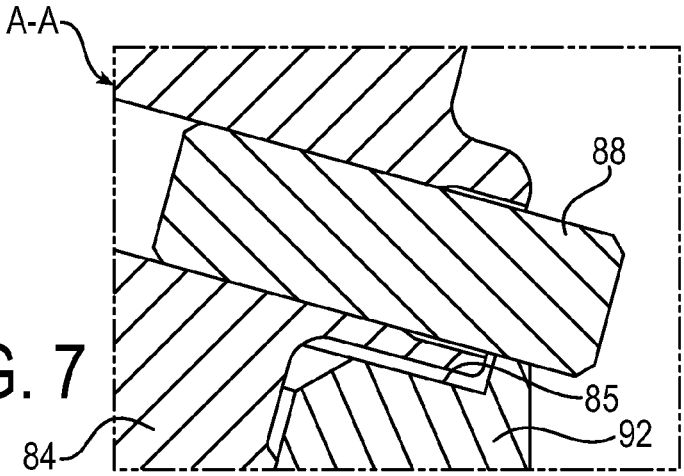
FIG. 7 is a close-up view of section A-A in FIG. 6.

Turning now to FIGS. 5-7, with reference to FIG. 3, an exemplary mounting portion 92 of the secondary release mechanism 80 is shown in further detail. In the illustrated embodiment, the mounting portion 92 is configured as a castellated protrusion. In exemplary embodiments, the secondary release pin 84 may be threaded into the housing 56, which allows for some mechanical advantage in removing the pin 84 when desired. It is understood, however, that the release pin 84 may be provided in an unthreaded configuration.

As shown, the secondary release mechanism 80 may include one or more retaining pins 88 disposed in a recess 90 of the mounting portion 92 of the housing. The retaining pin 88 may be configured to engage the mounting portion 92 when the release pin 84 is moved toward the release position, which may help to maintain the release pin 84 in the hold position during normal operation when vibration occurs, for example. In exemplary embodiments, the retaining pin(s) 88 may be configured to fracture or shear when loaded beyond a predetermined level for permitting the release pin 84 to continue to move toward the release position (e.g., removed from the housing 56). For example, in exemplary embodiments, the retaining pins 88 may be made of plastic having a relatively low shear strength or tensile strength, which allows them to shear when sufficient force is applied during rotation of the release pin 84 by the remote operated vehicle, for example.

In exemplary embodiments, the release pin 84 may be tightened down and the retaining pins 88 may be prevented from sliding out of the opening in the release pin 84, as shown in FIG. 7. Tightening of the release pin 84 to the counterbore surface 85 could result in the release pin 84 being over-torqued to a stop, which could present a problem at the time of removal of the release pin 84. For example, a remote operated vehicle may have a gripper jaw with approximately 150 lb-ft. of torque which it can apply to loosen an object. As an example, if the installation torque applied to the release pin were 100 lb-ft., and if the release pin accumulated marine growth (adding another 50 lb-ft. of break out torque, for example), and torque applied to the drive mechanism were to further add side load to the pin (adding an another 50 lb-ft. of breakout torque, for example), then the release pin may not be able to be removed by the remote operated vehicle gripper. Such a configuration of the secondary release mechanism mounting portion 92 may therefore prevent over-torqueing and alleviate such problems. Such configuration(s) of the secondary release mechanism mounting portion 92 also may act as evidence of tampering or improper installation of the secondary release pin 84, in that the fracture or absence of the retaining pins 88 may be indicative of intentional removal of the secondary release pin 84 or improper installation of the secondary release pin 84 in the housing 56.

Turning to FIGS. 8-10, with reference to FIG. 3, the exemplary stop collar 70 and the exemplary push-off flange 74 are shown in further detail. As discussed above, the stop collar 70 may surround a portion of the locking mechanism 46 and may be configured to engage a shoulder 72 of the locking mechanism for restricting forward movement of the locking mechanism 46 beyond a certain point. As shown in FIG. 9, in exemplary embodiments, the stop collar 70A may be a formed as a ring that is segmented or is formed as a C-shaped component that enables the stop collar 70A to be installed over the locking mechanism 46. In other embodiments, as shown in FIG. 10, the stop collar 70B may have an axial slot or section cut out to allow fitment over the shaft portion of the locking mechanism 46. Such configuration(s) of the stop collar enables the shoulder 72 and/or flange 74 to be integrated into the locking mechanism 46 such that the stop collar may be installed therebetween.

Referring particularly to FIG. 3, the flange 74 protrudes radially outwardly from a shaft portion of the locking mechanism 46 axially rearwardly of the cruciform-shaped head 48 and is longitudinally spaced apart from the shoulder 72. In this manner, the flange 74 forms an abutment surface for facilitating push-off between the free connector 12 and the fixed connector 14 (e.g., pushes against the socket 28 of the fixed connector 14) when the connectors are separated, and/or for facilitating mating between the free connector 12 and the fixed connector 14 when the connectors are mated together. Such a push-off flange 74 may be particularly useful under certain conditions of hyperbaric pressure that forces the connectors 12, 14 together, or when there is heavy marine growth resisting the disconnection of the connectors 12, 14. Such a configuration of the flange 74 may provide a simple and compact design that enables the locking mechanism 46 and guide sleeve 60 to be assembled from the front side of the free plate 37. This allows the locking mechanism 46 and/or the guide sleeve 60 to have smaller diameters, which thereby reduces the size and overall weight of the free connector 12.

Turning to FIG. 11, with reference to FIG. 3, the exemplary guide bushing 44 disposed in the free plate 37 of the free connector 12 is shown in further detail. As shown, the internal bore 45 of each bushing 44 may have different diameters at longitudinally spaced positions along the internal bore for allowing greater initial misalignment when the guide pin 26 is inserted into the guide bushing 44. In the illustrated embodiment, the internal bore 45 of the guide bushing 44 has a first internal diameter (D1) at a forward end portion that receives the guide pin 26, a second internal diameter (D2) rearwardly adjacent to the first internal diameter (D1) (such as an undercut), and a third internal diameter (D3) at a location rearwardly spaced apart from the first diameter (D1). As shown, the second internal diameter (D2) (e.g., undercut) is greater than the first (D1) and third (D3) internal diameters for enabling a greater angle of misalignment when the guide pin is initially inserted into the guide bushing. In this manner, the first diameter (D1) may direct the initial positional alignment, the second diameter (D2) may allow for initial angular misalignment, and the combination of the first (D1) and third (D3) diameters may bring the connectors 12, 14 into full angular alignment. It is noted that in exemplary embodiments, the first (D1) and third (D3) diameters may be different, while in other embodiments the first (D1) and third (D3) diameters may be about the same.

Such a configuration allows for some initial guide pin 26 to bushing 44 engagement and then a gradual transition to final alignment. In contrast, if the guide pin and corresponding bushing each had continuous diameters, then there could be binding during the initial alignment phase. In exemplary embodiments, the ratio of the length of the guide pin 26 contacting the internal bore 45 to the diameter of pin should be as large as reasonably possible, particularly near the end of the connection stroke when the couplers 16*a*, 16*b* are engaging and the greatest amount of alignment is typically required. Such a configuration also enables the guide pin 26 on the fixed connector 14 to be easier to manufacture as it can be made as one continuous diameter; whereas the free connector 12 may have the bushing 44 with a more complicated geometry. This is beneficial because the free connector 12 is easier to retrieve and service if necessary.

Figure 13:
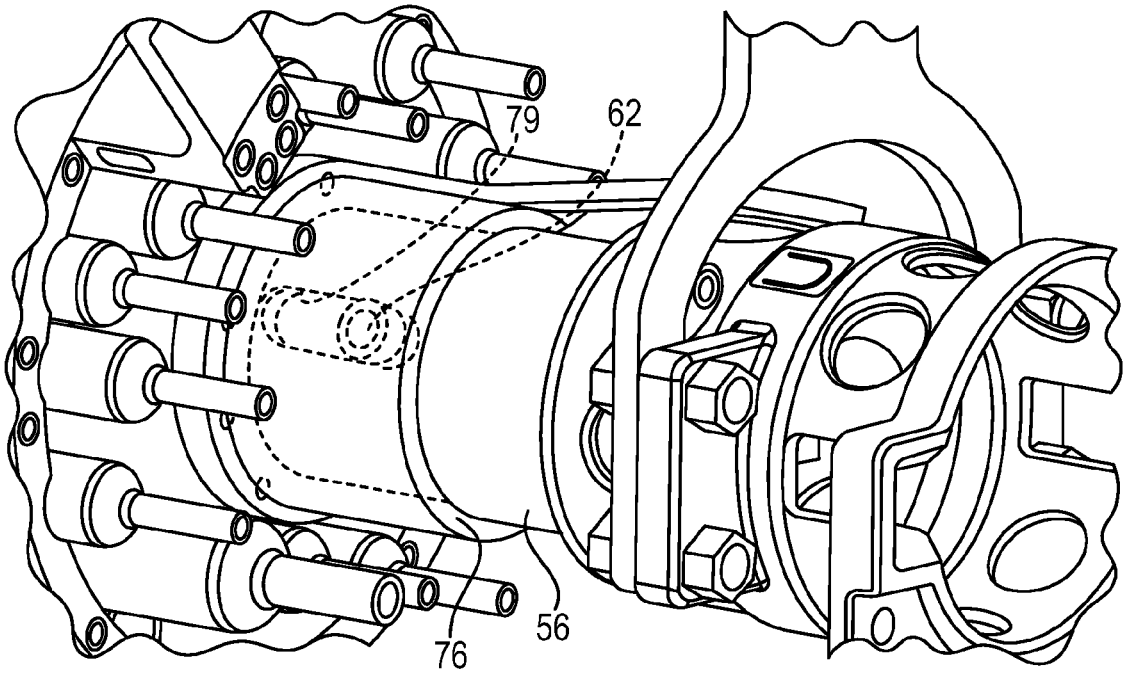
FIG. 13 is a perspective view of the housing shroud in FIG. 12 shown installed on the free connector in FIG. 2, with the housing shroud shown in transparent view.

Turning to FIGS. 12 and 13, with reference to FIG. 3, the exemplary housing shroud 76 is shown in further detail. As shown, the housing shroud 76 may surround at least a portion of the housing 56, and may have an indicator 78, such as an indicator bar, for indicating whether the locking mechanism is in the locked or unlocked position. In exemplary embodiments, the indicator bar 78 is integrated into the shroud 76, which may facilitate making the shroud out of a single piece of round stock. In contrast, if the shroud design were made with an indicator bar attached to the shroud, and the single piece of round stock for making the shroud were cut in half for installation about the housing, then after rejoining the segmented parts the shroud may have an oval shape (due to the material removal). The exemplary configuration of the housing shroud 76 having the integral indicator bar 78 may allow the single round piece to be cut in half for installation, and will still be round after rejoining and integrating the shroud 76 with the indicator component 78.

In the illustrated embodiment, the housing shroud 76 has one or more axial slots 79 configured to receive the one or more orientation pins 62 of the locking mechanism 46 (as shown in FIG. 13). In this manner, when the locking mechanism 46 is rotated between the locked position and unlocked position, the orientation pin 62 slides axially within the axial slot 79 to effect rotation of the housing shroud 76 about the axis independent of axial movement of the housing shroud 76, thereby rotating the indicator bar 78 and indicating whether the locking mechanism 46 is in the locked or unlocked position. Such a configuration enables the housing shroud 76 carrying the indicator bar 78 to cooperate with the orientation pin(s) 62 utilized for guiding the locking mechanism 46 as the pin(s) 62 are guided in the guide slot(s) 64. In addition, such a configuration allows the indicator bar 78 to read the orientation of the locking mechanism 46 even when the secondary release mechanism 80 is activated, since the orientation pin(s) 62 also would rotate during the second release function.

A connector such as a multi-coupler stabplate for coupling to or decoupling from another connector has been described herein. The connector includes one or more features that improve the securing or releasing function(s) of the connector to or from the other connector. For example, the connector may have a secondary release mechanism that allows a seized drive to be rotated to an unlocked position. In exemplary embodiments, integrated stop features may be provided during such secondary release. The secondary release mechanism may be mounted to the housing and retained with shear pins. Orientation pin(s) may be provided that cooperate with a guide slot(s) for oblique and axial movement of a locking mechanism during coupling/decoupling. A housing shroud may be provided for cooperating with the orientation pin(s) and indicating locked/unlocked states. A stop collar and push-off flange may be provided for facilitating coupling/decoupling. Guide bushings may be provided for facilitating alignment during coupling. In addition, one or more additional features may be provided that improve the securing/releasing function(s) of the connector.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A free connector for connecting to a fixed connector of a coupling, the free connector comprising:

a free plate having a front side and a back side;

a locking mechanism extending along an axis through the free plate for being received by the fixed connector, the locking mechanism being rotatable about the axis between a locked position for securing the free connector to the fixed connector, and an unlocked position for releasing the free connector from the fixed connector;

a housing disposed on the back side of the free plate, the housing being fixed relative to the free plate and surrounding at least a portion of the locking mechanism;

a guide sleeve interposed between the locking mechanism and the housing, the guide sleeve configured to guide movement of the locking mechanism between the locked position and the unlocked position; and a secondary release mechanism mounted to the housing, the secondary release mechanism having a hold state for restricting rotation of the guide sleeve relative to the housing, and a release state for permitting rotation of the guide sleeve relative to the housing;

wherein the secondary release mechanism includes a release pin that is movable between a hold position corresponding with the hold state, and a release position corresponding with the release state; and wherein the release pin extends through the housing and into a recess of the guide sleeve when the secondary release mechanism is in the hold position, and the release pin moves out of the recess of the guide sleeve when the secondary release mechanism is in the release position.

2. The free connector according to claim 1, wherein, when the secondary release mechanism is in the hold state and restricts rotation of the guide sleeve relative to the housing, the locking mechanism is guided by a guide slot in the guide sleeve to move between the locked position and unlocked position independent of movement of the guide sleeve.

3. The free connector according to claim 1, wherein, when the secondary release mechanism is in the release state and permits rotation of the guide sleeve relative to the housing, the locking mechanism is rotatable with the guide sleeve to move to the unlocked position independent of the locking mechanism being guided by the guide slot of the guide sleeve.

4. The free connector according to claim 1, wherein, the free connector is configured to operate with the secondary release mechanism in the hold state during normal operation, and the release state is activatable for when a drive mechanism that moves the locking mechanism is seized.

5. The free connector according to claim 1, wherein, when the secondary release mechanism is in the release state, the locking mechanism is movable to the unlocked position independent of the shearing of frangible elements.

6. The free connector according to claim 1, wherein the housing has a slot for cooperating with the locking mechanism, the slot being configured to restrict rotation of the locking mechanism beyond a predetermined displacement when the secondary release mechanism is in the release state.

7. The free connector according to claim 6, wherein the slot in the housing is configured as a through-slot; and wherein the locking mechanism includes an orientation pin configured to extend through the through-slot for engaging the housing defining the through-slot when the locking mechanism is rotated to the unlocked position.

8. The free connector according to claim 7, wherein the orientation pin of the locking mechanism is slidably movable in the guide slot of the guide sleeve to guide axial and/or circumferential movement of the locking mechanism; and wherein the guide slot includes an oblique portion extending in an oblique direction that is both axially away from the free plate and circumferentially toward the locked position; and wherein the guide slot further includes an axial portion extending in an axial direction away from the free plate.

9. The free connector according to claim 1, wherein the locking mechanism includes a drive nut at an end portion of the locking mechanism, the drive nut being engageable to rotate the locking mechanism between the locked position and unlocked position.

10. The free connector according to claim 1, further having a torque receptacle coupled to the housing.

11. The free connector according to claim 1, wherein the locking mechanism is configured as a bayonet having head portion configured with a cruciform-shaped cross-section for being received in a corresponding socket of the fixed connector.

12. The free connector according to claim 1, wherein the release position includes the release pin being detachably removed from the housing.

13. The free connector according to claim 1, wherein the secondary release mechanism includes a retaining pin disposed in a recess of a mounting portion of the housing; and wherein the retaining pin is configured to engage the mounting portion of the housing when the secondary release mechanism is moved toward the release position, and the retaining pin is configured to fracture when loaded beyond a predetermined level for permitting the secondary release mechanism to continue to move toward the release position.

14. The free connector according to claim 1, further including a stop collar that surrounds a portion of the locking mechanism for restricting forward movement of the locking mechanism toward the fixed connector.

15. The free connector according to claim 14, wherein the stop collar is disposed between the free plate and the housing.

16. The free connector according to claim 14, wherein the stop collar includes a slot for slipping over a portion of the locking mechanism, or wherein the stop collar is configured in a clamshell or dual-c shape configuration.

17. The free connector according to claim 1, wherein the locking mechanism includes a flange for facilitating push-off between the free connector and the fixed connector when the connectors are separated, and/or for facilitating mating between the free connector and the fixed connector when the connectors are mated together;

wherein the flange is disposed between a head portion of the locking mechanism and a stop collar surrounding at least a portion of the locking mechanism, and wherein the flange is independent of the stop collar.

18. The free connector according to claim 1, further including at least one guide bushing having an internal bore configured to receive at least one guide pin of the fixed connector;

wherein the internal bore of the at least one guide bushing has a first internal diameter at a first end that receives the guide pin, and a second internal diameter at a location spaced away from the first end, the first internal diameter being larger than the second internal diameter for enabling greater initial misalignment when the guide pin is initially inserted into the guide bushing.

19. The free connector according to claim 18, wherein the internal diameter of the internal bore gradually reduces from the first internal diameter to the second internal diameter.

20. A free connector for connecting to a fixed connector of a coupling, the free connector comprising:

a free plate having a front side and a back side;

a locking mechanism extending along an axis through the free plate for being received by the fixed connector, the locking mechanism being rotatable about the axis between a locked position for securing the free connector to the fixed connector, and an unlocked position for releasing the free connector from the fixed connector;

a housing operatively fixed to the free plate, the housing at least partially surrounding the locking mechanism on the back side of the free plate; and a housing shroud at least partially surrounding the housing;

wherein the housing shroud includes an axial slot configured to receive an orientation pin of the locking mechanism, such that as the locking mechanism and orientation pin are rotated between the locked position and unlocked position, the orientation pin slides axially within the axial slot to effect rotation of the housing shroud about the axis, independent of axial movement of the housing shroud, for indicating whether the locking mechanism is in the locked or unlocked position.

21. The free connector according to claim 20, wherein the orientation pin of the locking mechanism is guidable in a guide slot having an oblique portion that extends in a circumferential oblique direction relative to the axis, wherein the orientation pin extends through the guide slot and is received in the axial slot of the housing shroud, and wherein when the locking mechanism and orientation pin are rotated between the locked position and the unlocked position, the orientation pin is guided in the oblique portion of the guide slot to move in the circumferential oblique direction and the orientation pin slides axially within the axial slot of the housing shroud to effect rotation of the housing shroud about the axis.

* * * * *